US011015788B1

(12) United States Patent
Adams

(10) Patent No.: US 11,015,788 B1
(45) Date of Patent: May 25, 2021

(54) LIGHT FIXTURE WITH INTEGRAL HANDLE

(71) Applicant: ABL IP HOLDING LLC, Atlanta, GA (US)

(72) Inventor: Vincent P. Adams, Snellville, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 17/062,916

(22) Filed: Oct. 5, 2020

(51) Int. Cl.

| | |
|---|---|
| ***F21V 21/00*** | (2006.01) |
| ***F21V 21/40*** | (2006.01) |
| ***F21V 21/30*** | (2006.01) |
| ***F21V 21/14*** | (2006.01) |

(52) U.S. Cl.
CPC ..... *F21V 21/406* (2013.01); *F21V 21/145* (2013.01); *F21V 21/30* (2013.01); *F21V 21/40* (2013.01); *F21V 21/403* (2013.01)

(58) Field of Classification Search
CPC ..... F21V 21/406; F21V 21/145; F21V 21/30; F21V 21/40; F21V 21/403
USPC ..... 362/382, 399, 109
See application file for complete search history.

(56) References Cited

U.S. PATENT DOCUMENTS

| | | | | |
|---|---|---|---|---|
| 4,581,689 | A * | 4/1986 | Oram | F21V 21/30 362/275 |
| 6,123,071 | A * | 9/2000 | Berthon-Jones | A61M 16/06 128/204.18 |
| 2008/0239715 | A1* | 10/2008 | Deighton | F21V 17/007 362/183 |
| 2010/0302767 | A1* | 12/2010 | Mattheis | A01K 27/004 362/184 |
| 2019/0234587 | A1* | 8/2019 | Ohara | F21V 21/406 |
| 2019/0338933 | A1* | 11/2019 | Micunek | F21V 14/04 |

* cited by examiner

*Primary Examiner* — Laura K Tso
(74) *Attorney, Agent, or Firm* — Kilpatrick Townsend & Stockton LLP

(57) ABSTRACT

A light fixture having a housing and a handle formed integrally in the housing. In some embodiments, the handle is positioned at a center of gravity of the light fixture so as to facilitate carrying of the light fixture and/or to reduce stress on the carrier's hand.

20 Claims, 6 Drawing Sheets

LIGHT FIXTURE WITH INTEGRAL HANDLE

FIELD OF THE INVENTION

Embodiments of present invention relate to light fixtures with a carrying handle formed integrally therein.

BACKGROUND

Light fixtures need to be carried to their final installation locations. Conventional light fixtures typically require a user to carry the light fixture with both hands. This is particularly difficult if the installation location is elevated such that the user must also climb a ladder. In some instances, light fixtures may be retrofitted with a carrying handle that may be attached to the light fixture, often times on a top or bottom end of the light fixture. However, when the handle is positioned in these locations, carrying the light fixture can be difficult due to uneven distribution of the weight of the light fixture. Similarly, when carrying the light fixture, the light fixture is not level such that the light fixture may tilt or rock during transport due to the uneven weight distribution. This often results in stress, which may be felt in the hand of an installer. Furthermore, the handles fitted onto conventional light fixtures often require additional parts that add to the overall weight and cost of the light fixture. Thus, there is a need for a light fixture that includes a fully incorporated handle that is properly positioned such that the light fixture may be easily carried by an installer without unnecessary additional parts.

BRIEF SUMMARY OF THE INVENTION

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Described herein is a light fixture having a housing and a handle formed integrally in the housing. In some embodiments, the handle is positioned at a center of gravity of the light fixture so as to facilitate carrying of the light fixture and/or to reduce stress on the carrier's hand.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

Figure 1:
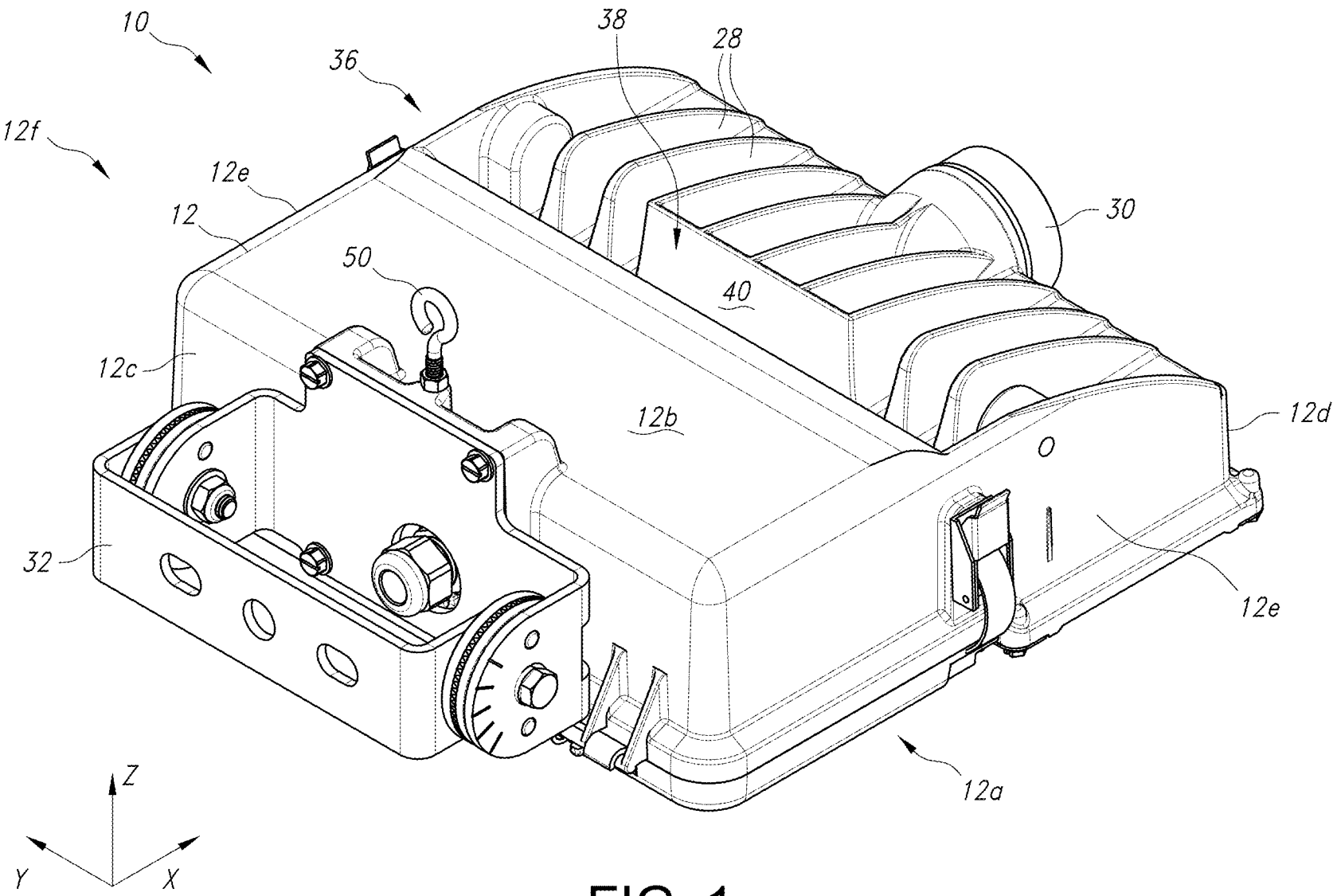
FIG. 1 is a top isometric view of a light fixture according to embodiments of the present disclosure.
Figure 2:
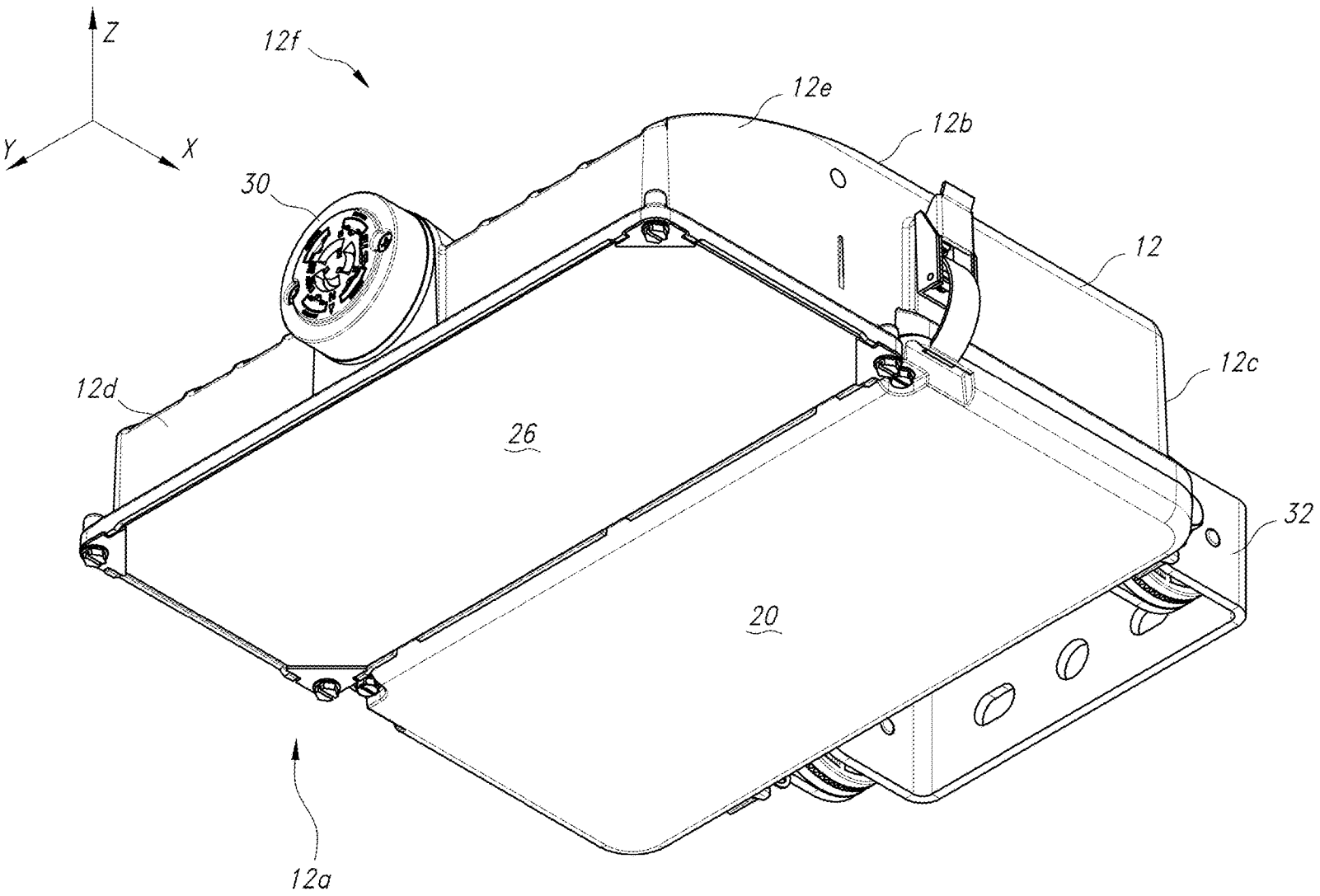
FIG. 2 is a bottom isometric view of the light fixture of FIG. 1.
Figure 3:
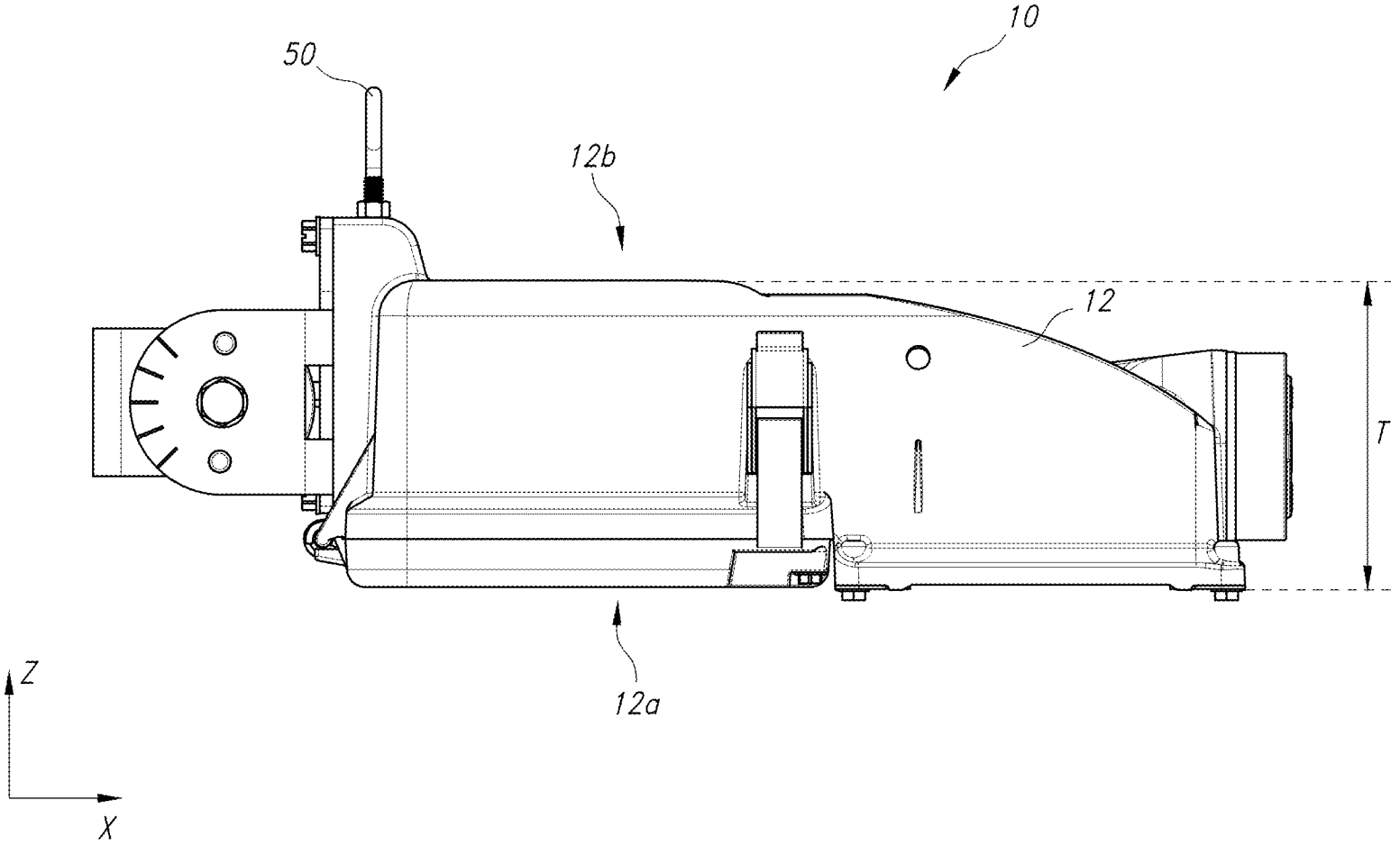
FIG. 3 is a side elevation view of the light fixture of FIG. 1.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Any descriptions relating to orientation, including but not limited to "upper," "lower," "up," "down," "above," "below" and the like, are intended to convey their ordinary meanings in the context of the orientation of the drawings being described; notwithstanding that the apparatus disclosed may be manufactured and/or installed in other orientations.

Disclosed is a light fixture 10 provided with a handle formed integrally in the light fixture 10 and positioned such that an installer can grip the light fixture 10 near a center of gravity of the light fixture 10. In some examples, the light fixture 10 is a flood light. However, embodiments of the integrated handle disclosed herein may be incorporated into a variety of types of light fixtures. The light fixture 10 can be pole-mounted, side-mounted, or otherwise mounted or supported at a location as desired. Various mechanisms and devices may be used to support the light fixture 10 in a particular location and/or orientation, including, but not limited to, a mounting bracket or yoke, a slip fitter that slips over the end of a mounting pole, a trunnion mount, and/or a knuckle. Moreover, while a rectilinear light fixture is illustrated herein, embodiments of the integrated handle disclosed herein may be incorporated into light fixtures of any kind and/or shape.

As illustrated in FIGS. 1-4, the light fixture 10 includes a housing 12 that extends in a plane. The light fixture 10 has a light emitting side 12*a* and an opposing upper side 12*f*. The housing 12 includes an upper portion or wall 12*b*, a rear portion or wall 12*c*, an opposing front portion or wall 12*d*, and opposing sidewalls 12*e* that extend between the front and rear portions or walls 12*c*, 12*d*. The housing 12 has a width W, a length L, and a thickness T (see FIGS. 3 and 4). The length L of the housing 12 is measured along an axis x, the width W is measured along an axis y, and the thickness T is measured along an axis z. The width W can be constant or vary along the length L of the housing 12, the length L can be constant or vary along the width W of the housing 12, and the thickness T can be constant or vary along the width W and/or length L of the housing 12.

Figure 5:
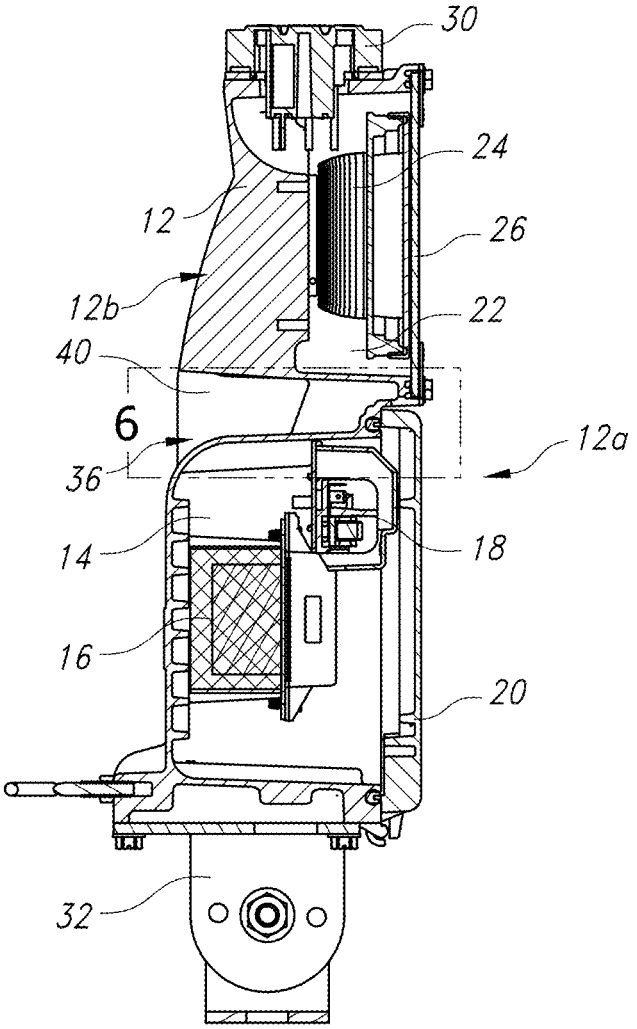
FIG. 5 is a cross-sectional view of the light fixture of FIG. 1, taken along line 5-5 in FIG. 4.

As best seen in FIG. 5, one or more cavities may be formed in the underside of the housing 12. In the illustrated embodiment, a rear cavity 14 is formed in the underside of the housing 12 in which are stored electronic components (e.g., driver(s) 16, terminal block 18). A cover plate 20 may be secured to the housing 12 to enclose the rear cavity 14. A front cavity 22 may be formed in the underside of the housing 12 to receive one or more light engines 24 (e.g., light sources, reflectors). The front cavity 22 may be enclosed by a lens 26.

The housing 12 may be formed of any material having suitable structural integrity and rigidity, including, but not limited to, polymeric and metallic materials. In some embodiments, the housing 12 is formed from materials also having suitable thermal management capabilities so as to conduct heat generated by electrical components housed therein. Metallic materials, such as, but not limited to, steel and aluminum, may be particularly suitable. The housing 12 may be formed using a variety of different technologies, including, but not limited to, die-forming, stamping, casting, etc.

In the illustrated embodiments, heat sink fins 28 extend along the upper wall 12*b* of the housing 12. The illustrated embodiment also includes a sensor 30 (e.g., photocell) provided on the front wall 12*d* and a trunnion mount 32 mounted to the rear wall 12*c* for mounting the light fixture 10. The inclusion, arrangement, and location of heat sink fins and/or a sensor(s) is entirely optional and, as discussed above, the light fixture 10 may be mounted via any of a variety of different mounting mechanisms (i.e., not necessarily via a trunnion mount).

Embodiments of the invention include an integrated handle 36 provided along the upper wall 12*b*. The handle 36 extends across at least a portion of the width W of the housing 12. In some embodiments, the integrated handle 36 is formed by a groove 38 formed in the upper wall 12*b* of the housing 12 so as to have a groove opening 39 exposed along the upper side 12*f* of the light fixture 10. In some embodiments, the handle 36 is formed integrally with the housing 12, thus eliminating the need for additional parts. While the handle 36 can have any cross-sectional geometry, in some embodiments at least one side of the handle 36 includes a substantially planar gripping surface 40. In the illustrated embodiment, the gripping surface 40 is located more proximate the front wall 12*d* than the back wall 12*c*, but its location within the groove can be altered. Moreover, the handle 36 may include more than one gripping surface.

In use, the installer may insert his/her hand/fingers through the groove opening 39 and into the groove 38 so that his/her hand/fingers contact the gripping surface 40. The gripping surface 40 can, but may not, extend across the entire width G of the groove 38. However, preferably the gripping surface 40 has a width F that is at least as wide as the average width of a human hand, such that the gripping surface 40 has a width that is at least 3 inches, larger than 3 inches, larger than 3.5 inches, larger than 4 inches, larger than 4.5 inches, larger than 5 inches, larger than 5.5 inches, or larger than 6 inches. The installer can then support and carry the light fixture 10 with his/her hand engaging the gripping surface 40. In some embodiments, the plane of the gripping surface 40 extends at an angle β that is substantially perpendicular to axis x; however, in other embodiments, angle β can be greater than 90° (such as, but not limited to, between 90° and 135° from axis x) or less than 90° (such as, but not limited to, between 45° and 90° from axis x).

Figure 6:
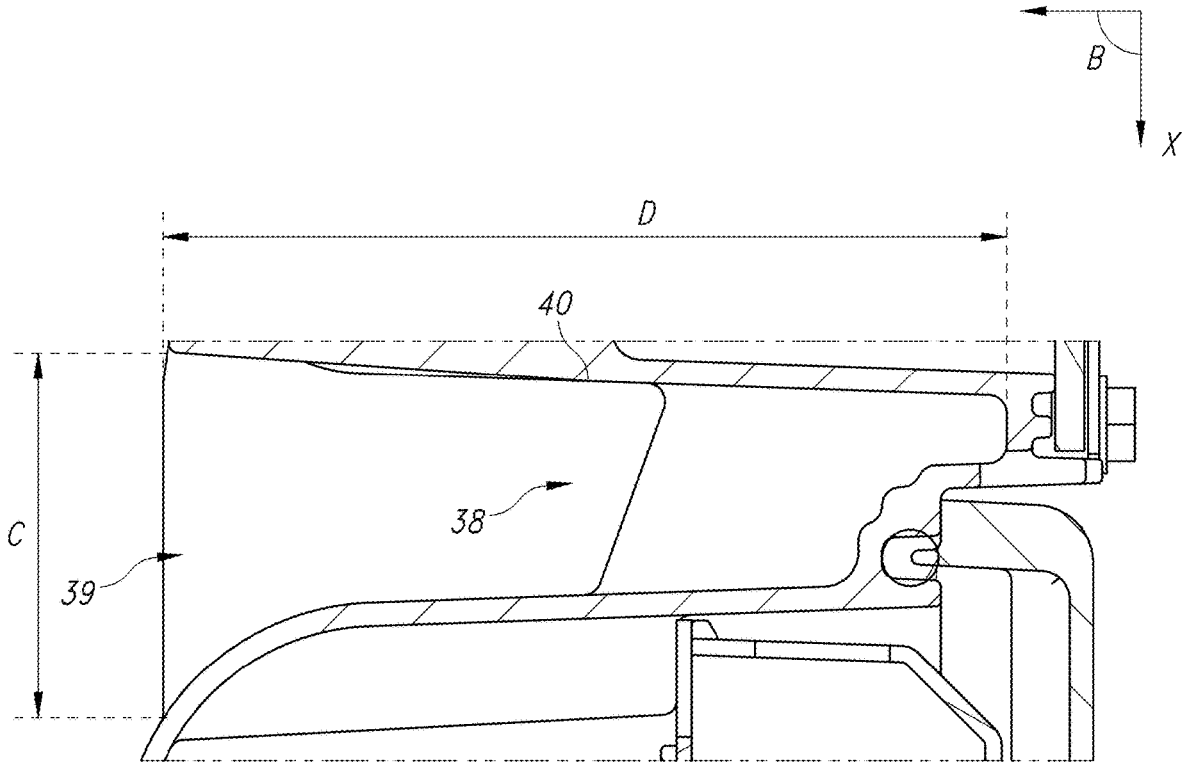
FIG. 6 is an enlarged view of the light fixture of FIG. 1, taken along inset 6 in FIG. 5.

As best seen in FIG. 6, the groove 38 may have a suitable thickness C and extend to a suitable depth D so as to permit insertion of the installer's hand through the groove opening 39 and within the groove 38. The thickness C may be constant or vary along the depth D of the groove 38. For example, as shown in FIG. 6, the groove thickness C is greater at the groove opening 39 but narrows or tapers along the depth D of the groove 38. In some embodiments, the groove 38 extends to a depth D that is at least to the center of gravity of the light fixture 10. In some embodiments, the depth D of the groove 38 extends through and/or beyond the center of gravity of the light fixture 10. In the illustrated embodiment, the groove 38 extends to a depth D that is slightly less than the thickness T of the housing 12. However, the depth D may be less in other embodiments. For example, the depth D may be at least 25%; between 25-95%, inclusive; between 35-95%, inclusive; between 40-95%, inclusive; between 50-95%, inclusive; between 60-95%, inclusive; between 50-90%, inclusive; between 60-90%, inclusive; between 70-90%, inclusive; between 80-90%, inclusive; between 50-80%, inclusive; between 60-80%, inclusive; between 70-80%, inclusive; between 40-70%, inclusive; between 50-70%, inclusive; and/or between 60-70%, inclusive of the thickness T of the housing 12 (where thickness T can be either the greatest measured thickness T of the housing 12 or the thickness T of the housing 12 immediately adjacent the groove 38).

Figure 4:
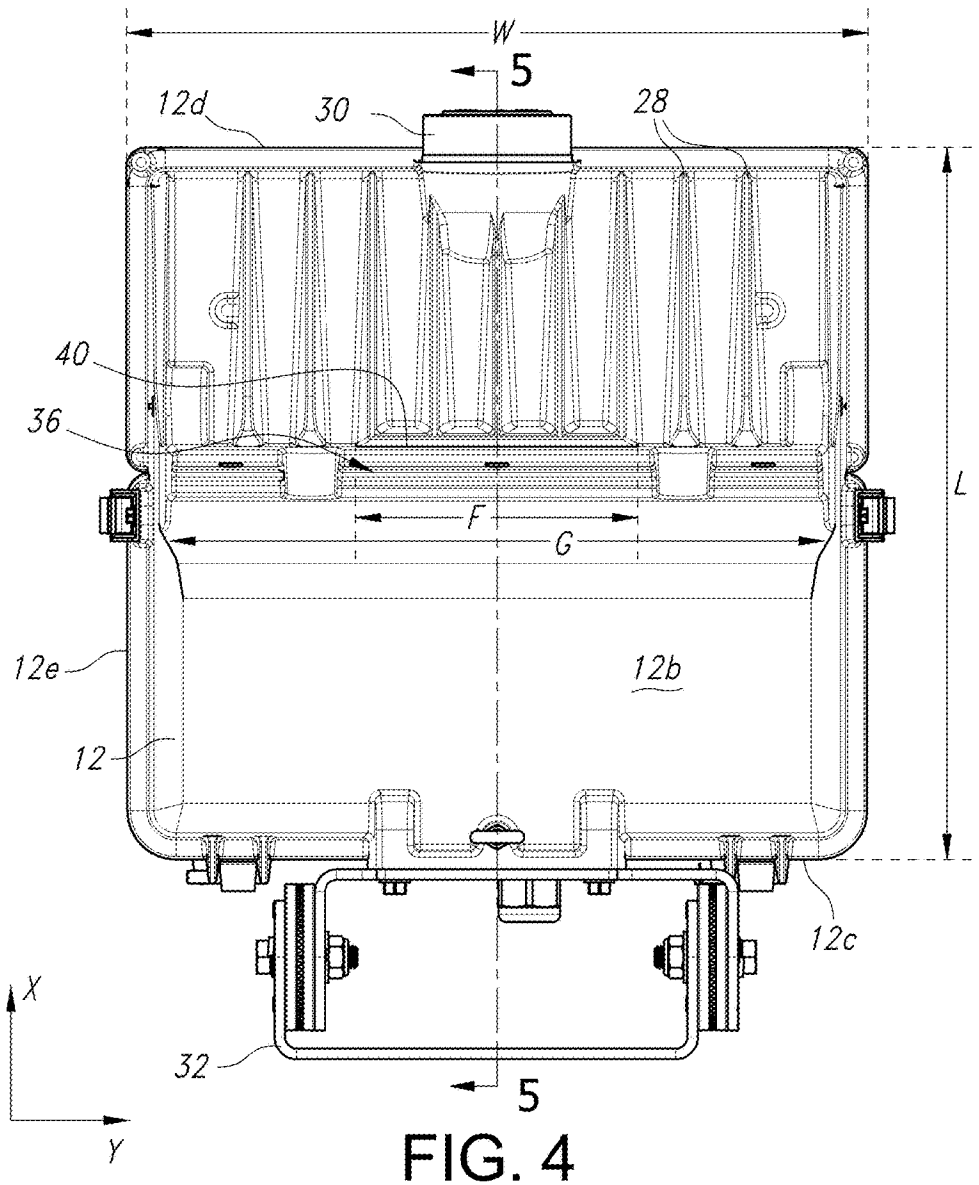
FIG. 4 is a top plan view of the light fixture of FIG. 1.

In some embodiments, the groove 38 extends substantially parallel to axis y. However, in other embodiments, the groove 38 can extend substantially parallel to axis x or may extend at an oblique angle to axis x and axis y. The groove 38 can extend only partially across the width W of the housing 12 or across substantially the entire width W of the housing 12. As illustrated in FIG. 4, the width F of the groove 38 may be sufficient to permit a hand to be inserted into and removed from the groove 38 with ease. The groove 38 may extend across the upper wall 12*b* of the housing 12 at any location along the length L of the housing 12. In some embodiments, the groove 38 is provided such that the handle 36, in particular the gripping surface 40 of the handle 36, is positioned near a center of gravity of the light fixture 10. Positioning the handle 36 near the center of gravity provides additional stability such that the light fixture 10 balances on a user's hand during transport. Thus, the amount of stress on the user's hand may be reduced during transportation of the light fixture 10.

In some embodiments, an undercut that creates a gripping hook may be provided in the handle 36 to assist with retention of the light fixture 10 on the installer's fingers. For example, an undercut (not shown) could be provided along the gripping surface 40. Moreover, additional gripping features, such as rubber pads, may be provided on the gripping surface 40 to facilitate retention. In still other embodiments, the angle β may be less than 90° to help prevent the light fixture 10 from slipping off the installer's fingers.

In some embodiments, the housing 12 of the light fixture 10 may include means for attaching a device for suspending the light fixture 10 from the installer. For example, in the illustrated embodiment, an eye bolt 50 is screwed into an aperture (not visible) in the housing 12. In use, the installer can use the eye bolt 50 to clip, or otherwise attach, the light fixture 10 to his/her tool belt. Such attachment is particularly useful when the installer must climb a ladder or in other situations where he/she needs both hands.

Different arrangements of the components described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

What is claimed is:

1. A light fixture having an upper side and an opposing light emitting side, the light fixture comprising:

a housing comprising a housing length measured along axis x, a housing width measured along axis y that is perpendicular to axis x, a housing thickness measured along axis z that is perpendicular to axis x and to axis y, and an upper wall;

a handle integral with the housing and formed by a groove provided in the upper wall that extends downwardly from the upper side towards the light emitting side of the light fixture, wherein the groove comprises a groove thickness, a groove width, and a groove depth;

wherein the handle comprises a gripping surface that is oriented at an angle between 45-135° relative to axis x; and wherein the handle is disposed substantially at a center of gravity of the light fixture.

2. The light fixture of claim 1, wherein the groove width is less than the housing width.

3. The light fixture of claim 1, wherein the groove width is substantially equal to the housing width-.

4. The light fixture of claim 1, wherein the groove width extends along a groove axis that is substantially parallel to axis y.

5. The light fixture of claim 1, wherein the groove thickness varies along the groove depth.

6. The light fixture of claim 5, wherein the groove thickness decreases along the groove depth from the upper side towards the light emitting side of the light fixture.

7. The light fixture of claim 1, wherein the groove depth is at least 50% of the housing thickness.

8. The light fixture of claim 7, wherein the groove depth is between 60% and 95%, inclusive, of the housing thickness.

9. The light fixture of claim 1, wherein the gripping surface is substantially planar.

10. The light fixture of claim 1, wherein the angle is substantially perpendicular to axis x.

11. The light fixture of claim 1, wherein the angle is between 45° and 90°, inclusive, relative to axis x.

12. The light fixture of claim 1, further comprising at least one light engine for emitting light from the light emitting side.

13. A light fixture having an upper side and an opposing light emitting side, the light fixture comprising:

a housing comprising a housing length measured along axis x, a housing width measured along axis y that is perpendicular to axis x, a housing thickness measured along axis z that is perpendicular to both axis x and axis y, and an upper wall;

a handle integral with the housing and formed by a groove provided in the upper wall that extends downwardly from the upper side towards the light emitting side of the light fixture and that comprises a groove thickness, a groove width, and a groove depth;

wherein the groove depth is at least 50% of the housing thickness;

wherein the handle comprises a substantially planar gripping surface that is oriented at an angle relative to axis x; and wherein the handle is disposed substantially at a center of gravity of the light fixture.

14. The light fixture of claim 13, wherein the angle is between 45° and 135°, inclusive, relative to axis x.

15. The light fixture of claim 13, wherein the groove extends along a groove axis that is substantially parallel to axis y.

16. The light fixture of claim 15, wherein the groove thickness decreases along the groove depth from the upper side towards the light emitting side of the light fixture.

17. The light fixture of claim 13, wherein the groove width is less than the housing width.

18. The light fixture of claim 13, wherein the groove width is substantially equal to the housing width.

19. The light fixture of claim 13, wherein the groove thickness varies along the groove depth.

20. The light fixture of claim 13, wherein the angle is between 45° and 90°, inclusive, relative to axis x.

* * * * *